US012576323B2

(12) United States Patent
Miller et al.

(10) Patent No.: US 12,576,323 B2
(45) Date of Patent: Mar. 17, 2026

(54) BASEBALL AND SOFTBALL HITTING TRAINING DEVICE

(71) Applicants: Thomas Miller, Baltimore, MD (US); Ricky D. Venters, Jr., Abingdon, MD (US); Justin Mack, Ft. Howard, MD (US); Samantha Verzi, Forest Hill, MD (US); Cyrus Etemad-Moghadam, Forest Hill, MD (US)

(72) Inventors: Thomas Miller, Baltimore, MD (US); Ricky D. Venters, Jr., Abingdon, MD (US); Justin Mack, Ft. Howard, MD (US); Samantha Verzi, Forest Hill, MD (US); Cyrus Etemad-Moghadam, Forest Hill, MD (US)

( * ) Notice: Subject to any disclaimer, the term of this patent is extended or adjusted under 35 U.S.C. 154(b) by 708 days.

(21) Appl. No.: 17/718,912

(22) Filed: Apr. 12, 2022

(65) Prior Publication Data

US 2023/0123369 A1 Apr. 20, 2023

Related U.S. Application Data

(60) Provisional application No. 63/149,269, filed on Feb. 13, 2021.

(51) Int. Cl.

| | |
|---|---|
| ***A63B 71/00*** | (2006.01) |
| ***A63B 69/00*** | (2006.01) |
| *A63B 102/18* | (2015.01) |

(52) U.S. Cl.

CPC .. *A63B 69/0002* (2013.01); *A63B 2069/0008* (2013.01); *A63B 69/0075* (2013.01); *A63B 2102/18* (2015.10); *A63B 2102/182* (2015.10)

(58) Field of Classification Search

CPC ..... A63B 69/0002; A63B 2069/0008; A63B 69/0075

USPC ..... 473/417

See application file for complete search history.

(56) References Cited

U.S. PATENT DOCUMENTS

| | | | | |
|---|---|---|---|---|
| 3,662,435 | A | 5/1972 | Allsop | |
| 4,812,484 | A | 3/1989 | Endo et al. | |
| 5,928,092 | A * | 7/1999 | Keeter | A63B 69/0075 473/417 |
| 6,878,077 | B2 * | 4/2005 | Andrews | A63B 69/0002 473/453 |
| 6,984,184 | B2 | 1/2006 | Gray | |
| 7,128,658 | B2 | 10/2006 | DuFour | |
| 8,147,357 | B1 | 4/2012 | Nichols | |
| 8,257,202 | B1 * | 9/2012 | Stanek | A63B 69/0002 473/422 |
| 8,556,753 | B1 * | 10/2013 | Dixon, Jr. | A63B 69/0002 473/422 |
| 8,597,143 | B2 * | 12/2013 | Newman | A63B 69/0075 473/422 |

(Continued)

*Primary Examiner* — Mitra Aryanpour

(74) *Attorney, Agent, or Firm* — KaiderLaw; Brian D. Kaider

(57) ABSTRACT

The present invention is a baseball and softball hitting training device that prevents early arm extension, early wrist release, swinging the bat from the outside to the inside, throwing the back shoulder toward the plate, or otherwise casting the hands during a swing. The device comprises a support block with one or more grooves, a horizontal bar mounted perpendicular to the support block, a flag indicator connected perpendicular to the horizontal bar, and one or more attachment straps.

2 Claims, 9 Drawing Sheets

(56) References Cited

U.S. PATENT DOCUMENTS

| | | | | |
|---|---|---|---|---|
| 8,602,920 | B2 * | 12/2013 | Windsor | A63B 69/0002 473/417 |
| 8,992,348 | B2 * | 3/2015 | Meier | A63B 69/0057 473/422 |
| 2008/0085787 | A1 * | 4/2008 | Molloy | A63B 69/0075 473/417 |
| 2016/0129329 | A1 * | 5/2016 | Fadde | A63B 69/0002 473/417 |

* cited by examiner

BASEBALL AND SOFTBALL HITTING TRAINING DEVICE

BACKGROUND OF THE INVENTION

Proper swing mechanics are necessary to generate speed, power, and accuracy when hitting a baseball or softball. When the hitter swings a bat while keeping the hands close to the body and the end of the bat near the rear shoulder through the early stages of the swing, it results in a faster, more compact, more powerful, and more accurate swing than if the hands are further away from the body, referred to as casting the hands. There are several causes of casting, including: early arm extension (sometimes referred to as "barring out"), unloading the grip too early, rotating too soon, early wrist release, swinging the bat from the outside to the inside instead of vice versa, and throwing the back shoulder toward the plate. Regardless of the cause, the result of casting is a rounder, slower, less accurate swing.

Baseball and softball coaches have developed various drills to assist players in identifying casting mistakes in their swings. For example, a player may place a tee near a net, such that the net is parallel to the desired travel of the ball. If the player casts their hands in the swing, the bat will make contact with the net. However, this drill requires access to a net, which may not be available. Further, wind may cause the net to blow into the path of the bat even in the absence of casting, causing confusion and frustration for the player. The same drill may be performed using a fence instead of a net, but repeated contact with a metal fence can cause damage to the player's bat. Another drill uses a heavy bag, pole, or other obstruction placed near the player, forcing the batter to lead the swing with their hands and keep the bat close to the back shoulder until past the obstruction. While this drill may be effective, it requires proper placement of the obstruction in order to teach the proper swing angle. Further, objects such as heavy bags are not easily portable.

Others have developed devices meant to teach batters proper swing mechanics including casting avoidance. However, these prior solutions suffer from a variety of disadvantages. For example, U.S. Pat. No. 7,128,658 issued to DuFour describes a device that may be used to help both golfers and baseball/softball players develop correct swing positioning. The user of the DuFour device wears a shoulder harness on the leading shoulder that attaches through a flexible, non-elastic tether to the striking end of a practice bat or club. By keeping the tether taut as the player simulates a swing, they are prevented from breaking or snapping the wrists too early or over-extending their hands away from the body. This design suffers several disadvantages, however. First, the harness may be uncomfortable, and may be difficult to put on for younger players. Second, the length of the tether must be adjusted according to the user's size, and it may be difficult for novice or younger players to determine the correct position. Third, while the device may help develop muscle memory for positioning the body in the early stages of a swing, the user cannot take an actual, full-speed swing at a ball while wearing the device. Consequently, the device does not provide feedback to the user in an actual hitting situation.

U.S. Pat. No. 6,984,184 issued to Gray disclosed an apparatus for building muscle memory to develop a more rapid baseball swing and avoid casting of the hands and bat during the swing. Such apparatus includes a first attachment member connectable to an upper arm and a second attachment member connectable to an opposing forearm interposed by an elongated tether to be aligned along a forearm upon initially entering into a hitter's stance. However, the Gray device may be uncomfortable for the user, difficult to adjust, may not be practical to use in a full-strength swing of the bat, and only restricts movement rather than providing feedback to the user on the mechanics of their swing.

U.S. Pat. No. 8,147,357 issued to Nichols disclosed an apparatus with two channels in which a connector attached to a handle would slide. The user would hold the handle as if a bat and their motion in swinging the handle would be restricted by the channels, thus teaching a proper swing motion. The Nichols device, however, is a stand-alone unit that cannot be attached to separate tees. It is only adjustable in a vertical aspect to accommodate players of different heights. It only restricts movement to teach muscle memory, rather than providing feedback to the user in an actual ball-hitting situation.

There is a need for a simple, portable, inexpensive device that will provide instant feedback to hitters when they cast their hands in a swing, ensure proper swing angles, is durable enough for heavy use, can be used with any size or brand of tee, and is adjustable for players of any size, age, or skill level.

SUMMARY OF THE INVENTION

The hitting training device of the present invention overcomes all of the disadvantages of the known devices meant to address casting, described above. The hitting training device comprises at least the following elements: a support block with one or more grooves; a horizontal bar mounted perpendicular to the support block; a flag indicator connected perpendicular to the horizontal bar; and one or more attachment straps connected to the support block. To place the hitting training device in position for use, as shown in FIG. 7, the user places one of the grooves of the support block along the shaft of a baseball or softball tee and secures the support block to the tee by wrapping the attachment straps around the shaft of the tee and attaching to the support block, thereby clamping the support block to the tee. The horizontal bar extends from the support block perpendicular to the shaft of the tee and holds the flag indicator substantially parallel to the shaft of the tee.

The user places a ball on top of the tee, just as if using the tee without the hitting training device being present. The user then stands at a distance from the tee such that if the user executes a correct swing, they will strike the ball at the optimal location on the bat. The user then swings the bat. If the swing is correct, the user will strike the ball without making any contact with the hitting training device. If, however, the user's hands become extended away from the body, i.e., casting, the bat will strike the flag indicator, providing immediate feedback that the swing was incorrect.

The horizontal bar has a groove or plurality of openings, which allow the flag indicator to be positioned at various distances from the shaft of the tee, thereby allowing for adjustment of the device to accommodate players of different skill levels. The flag indicator comprises an elongated portion that is releasably attached to a base portion such that if the flag indicator is struck by the hitter's bat during use of the device, the elongated portion of the flag indicator may be knocked over or released from the base portion without damaging the flag indicator or the horizontal bar, thereby giving the hitter instant feedback regarding the swing.

The hitting training device of the present invention provides numerous advantages and benefits. It is small, light, and portable so may be used at home or may easily be taken to remote locations. It easily attaches to any baseball or softball tee and can be attached to different portions of the tee shaft with minor adjustments. It is easy to adjust for users of different size, age, or skill level. It is simple to understand and operate. It provides immediate feedback on the user's swing without the need for a coach, trainer, or recording device. It is durable enough to withstand repeated contact with the user's bat.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
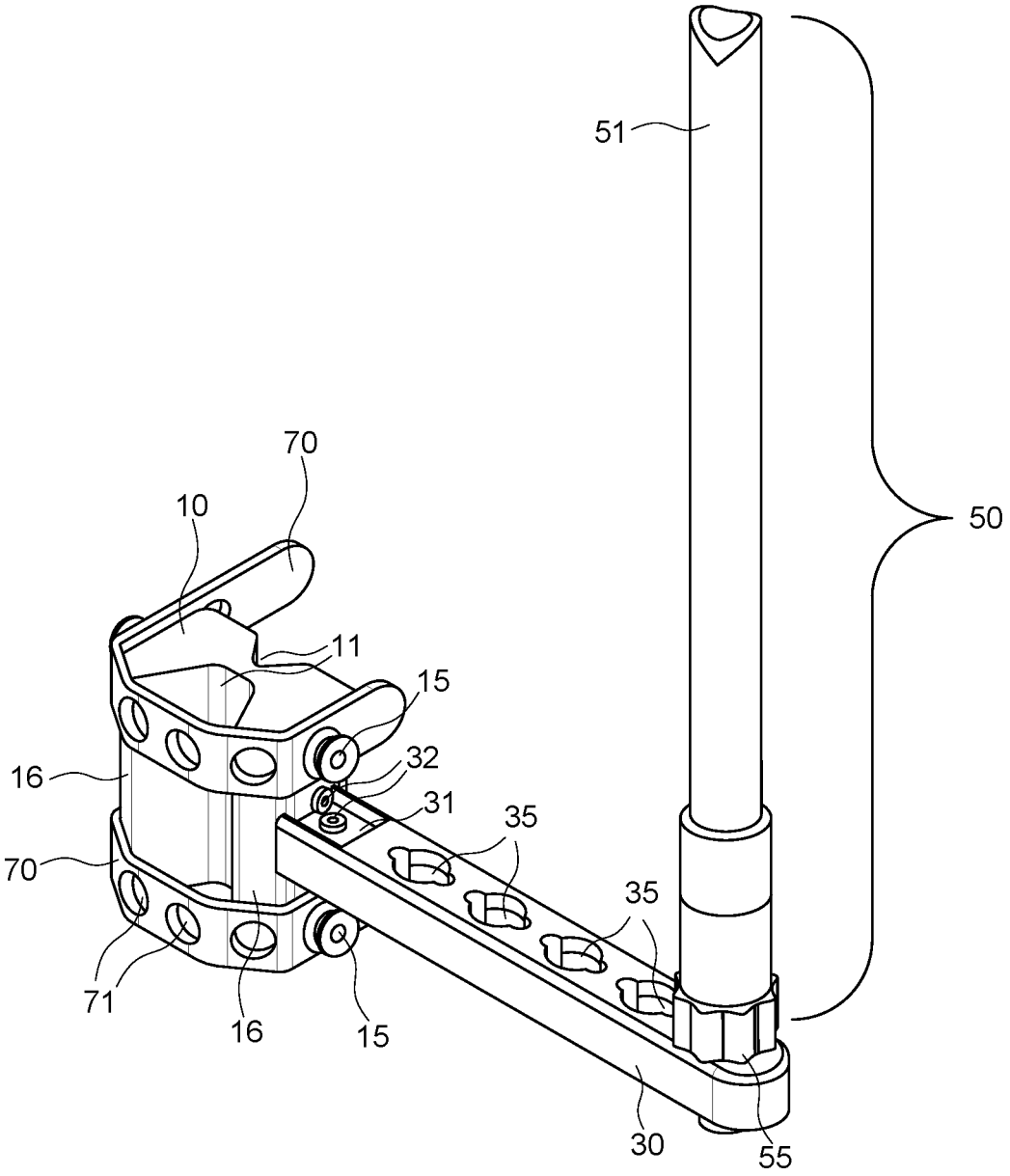
FIG. 1 shows a perspective view taken from the front, top, and right side of a representative embodiment of the assembled hitting training device in the closed configuration.

Reference is made herein to the attached drawings. Like reference numerals are used throughout the drawings to depict like or similar elements of the invention. For the purposes of presenting a brief and clear description of the present invention, a preferred embodiment will be discussed as used for reducing instances of casting when swinging a baseball or softball bat. The figures are intended for representative purposes only and should not be considered to be limiting in any respect.

Referring now to FIG. 1, there is shown a perspective view taken from the front, top, and right side of a representative embodiment of the assembled hitting training device in the closed configuration, comprising at least the following elements: a support block 10 with one or more grooves; a horizontal bar 30 mounted perpendicular to the support block 10; a flag indicator 50 connected perpendicular to the horizontal bar 30; and one or more attachment straps 70 connected to the support block 10.

Support block 10 may be formed from any sturdy material, including, but not limited to: plastic, hard rubber, metal, wood, composite products, or any combination thereof. The dimensions of the support block 10 may vary, but should be of sufficient size to provide adequate support to the overall device to withstand stress placed on the support block as a result of contact between a user's bat and the flag indicator. In one embodiment, the support block 10 is between 1.0 and 6.0 inches in height, between 1.0 and 6.0 inches in width, and between 1.0 and 4.0 inches in depth. One or more edges 16 of support block 10 may be rounded or beveled in order to reduce stress on the attachment straps 70 when in the closed configuration.

Figure 2A:
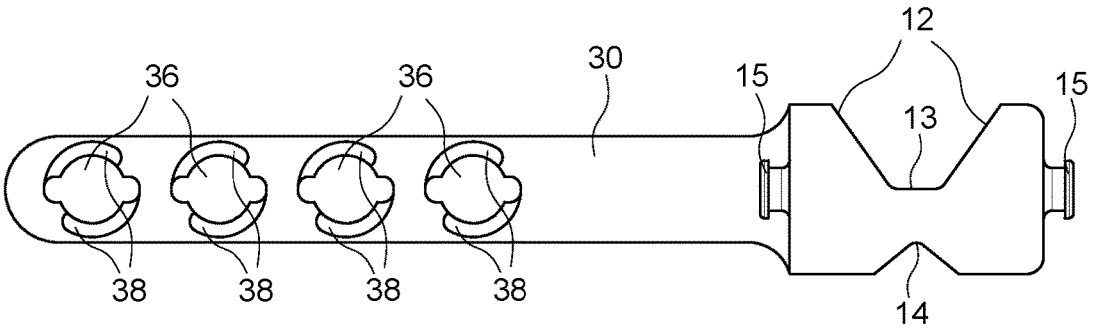
FIG. 2A shows a bottom view of one embodiment of the support block and horizontal arm of the hitting training device.

Support block 10 further comprises one or more grooves, channels, or recesses extending from the top surface to the bottom surface. Grooves 11 may be square or rectangular shaped, curved, U-shaped, V-shaped, or any other configuration that provides lateral support to the hitting training device when attached to the shaft of a baseball/softball tee. As shown in FIG. 2A, in one embodiment, one vertical face of support block 10 comprises a substantially V-shaped groove 12 with a flat bottom 13 and an opposing vertical face comprises a narrower, substantially V-shaped groove 14. In this embodiment, groove 12 is suitable for securing the hitting training device to the lower, wider portion of a baseball/softball tee, whereas groove 14 is suitable for securing the hitting training device to the upper, more narrow portion of a baseball/softball tee.

Support block 10 may further comprise one or more knobs or protrusions 15 suitable for engaging with one or more holes 71 in attachment straps 70. As shown in the cross sectional view of FIG. 2C, in one embodiment, support block 10 and protrusions 15 are molded, cast, carved, or otherwise formed as a single piece. In another embodiment, protrusions 15 are separate pieces from support block 10 and may be attached thereto by threads, friction fit, screws, bolts, or any other means known in the art.

Horizontal bar 30 may be formed from any sturdy material, including, but not limited to: plastic, hard rubber, metal, wood, composite products, or any combination thereof. The dimensions of the horizontal bar 30 may vary, but should be of sufficient size to permit adjustment of the flag indicator 50 position to accommodate players of different skill levels. In one embodiment, the horizontal bar 30 is between 0.5 and 2.0 inches in height, between 3.0 and 15 inches in length, and between 0.5 and 2.0 inches in width. One of ordinary skill in the art would understand that horizontal bar 30 may be attached to support block 10 by a variety of means. In one embodiment, horizontal bar 30 has a threaded end that engages with a threaded hole in support block 10. In another embodiment, horizontal bar 30 is attached to support block 10 by a bolt that is either directly threaded into both the horizontal bar and the support block or into threaded inserts placed in one end of the horizontal bar and one side of the support block. As shown in FIG. 1, in another embodiment, horizontal bar 30 is attached to support block 10 using one or more L-shaped brackets 31 and mounting screws 32. As shown in the cross sectional view of FIG. 2C, in another embodiment, horizontal bar 30 and support block 10 are molded, cast, carved, or otherwise formed as a single piece, rather than being separate components.

In one embodiment, horizontal bar 30 contains a plurality of openings 35 along its length. These openings may be in the form of holes, apertures, counterbores, counterbores with keyways, or recesses and may or may not extend through the entire height of the horizontal bar. The openings 35 are sized to accommodate an attachment mechanism on the base portion of the flag indicator 50, such that the flag indicator may be secured in any one of the openings along the horizontal bar.

Figure 2B:
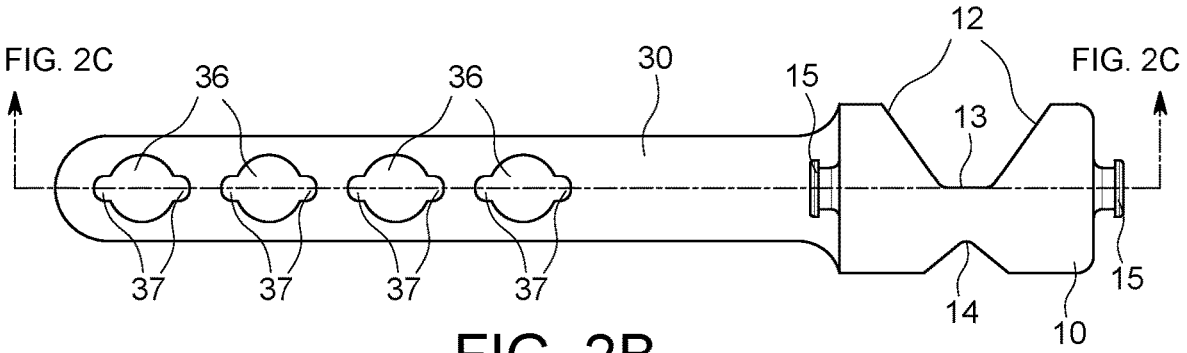
FIG. 2B shows a top view of one embodiment of the support block and horizontal arm of the hitting training device.
Figure 2C:
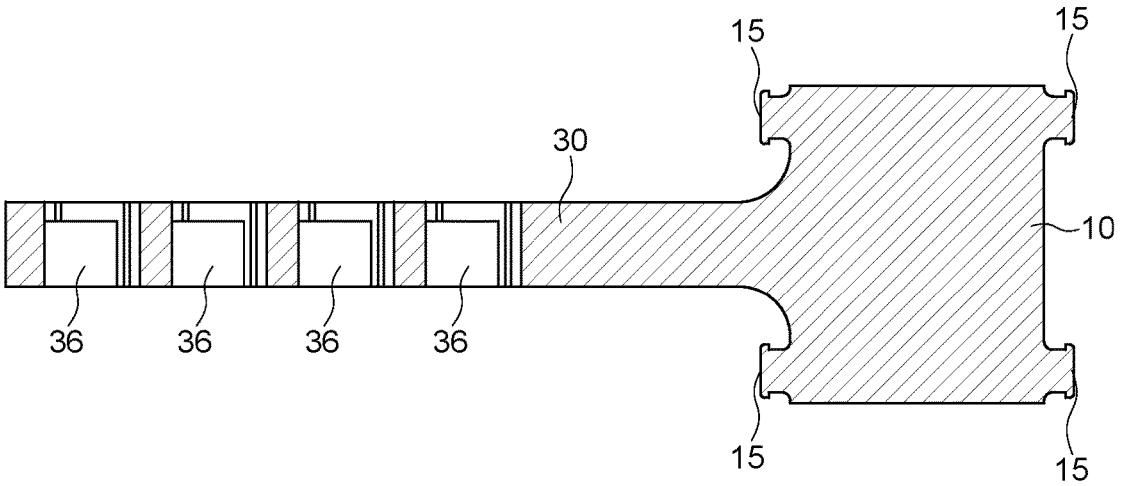
FIG. 2C shows a cross sectional view of the embodiment shown in FIG. 2B.
Figure 2D:
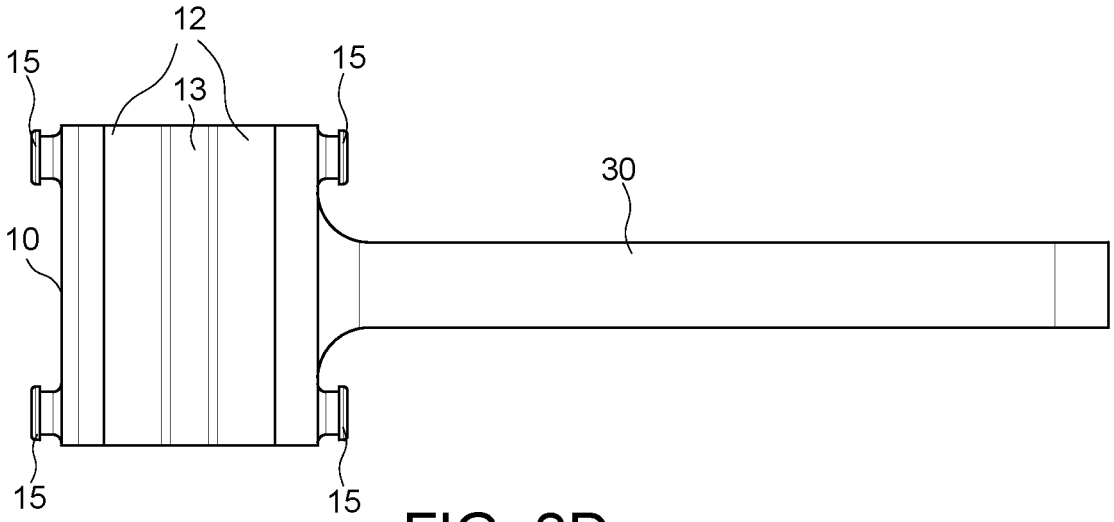
FIG. 2D shows a front view of one embodiment of the support block and horizontal arm of the hitting training device.
Figure 2E:
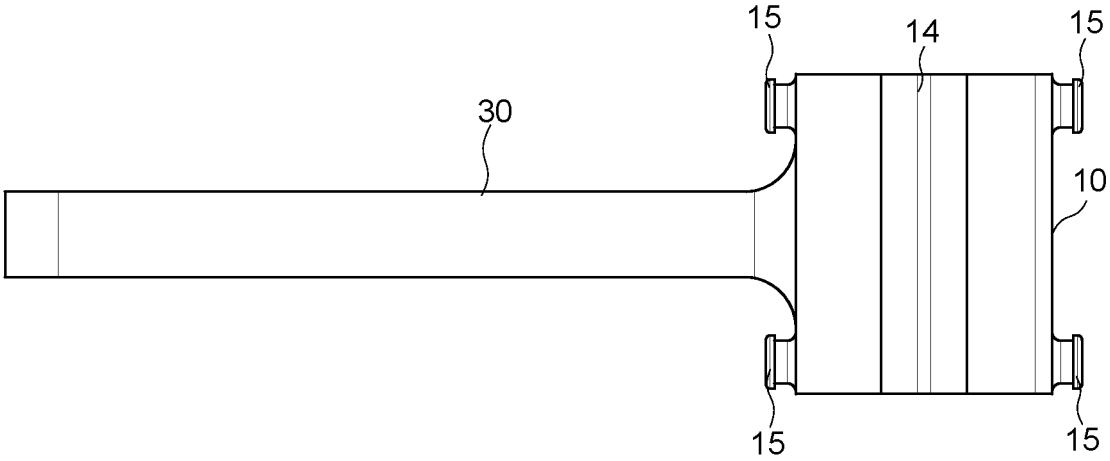
FIG. 2E shows a rear view of one embodiment of the support block and horizontal arm of the hitting training device.
Figure 2F:
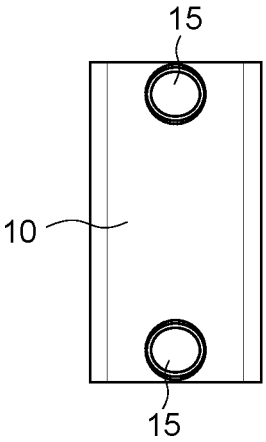
FIG. 2F shows a left side elevational view of one embodiment of the support block of the hitting training device.
Figure 2G:
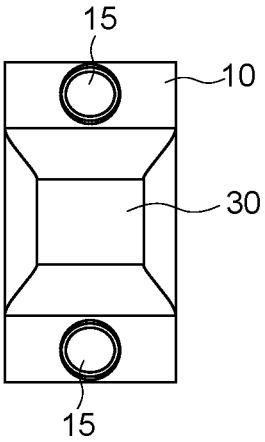
FIG. 2G shows a right side elevational view of one embodiment of the support block and horizontal arm of the hitting training device.
Figure 3A:
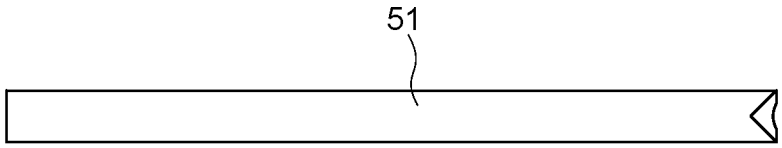
FIG. 3A shows a front view of one embodiment of the flag of the hitting training device.
Figure 3B:
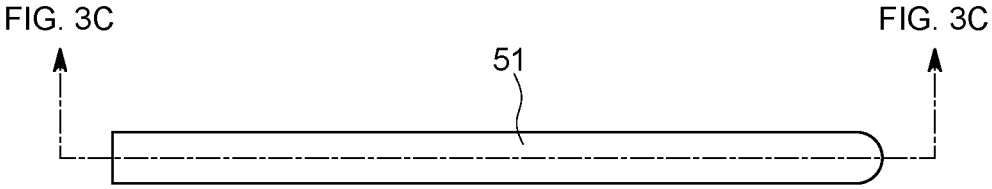
FIG. 3B shows a front view of another embodiment of the flag of the hitting training device.
Figure 3C:
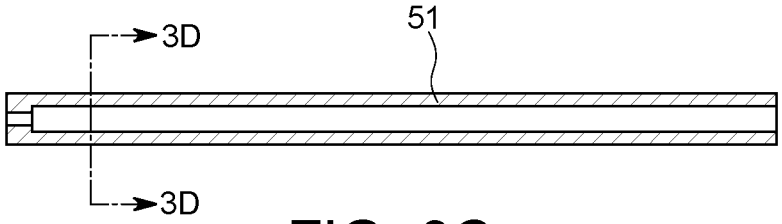
FIG. 3C shows a cross sectional view of the embodiment shown in FIG. 3B.
Figure 3D:
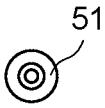
FIG. 3D shows a cross sectional view of the embodiment shown in FIG. 3C.

FIGS. 2A-C show a representative embodiment of the support block and horizontal arm, in which openings 35 comprise a plurality of counterbores with keyways. FIGS. 5A-D show a keyed embodiment of the base portion 55 of the flag indicator 50. In the embodiment shown in FIGS. 5A-D, the base portion 55 comprises the following elements: a knob 60, a shaft 56, two protrusions or keys 57, a bore 58 running through the center of the base portion from the top to the bottom, an enlarged bore portion 61 in the bottom surface, and a convex recess 59 in the top surface. In the embodiment shown in FIGS. 2A-C, the openings 35 on the horizontal bar 30 comprise the following elements: a main bore 36, two keyway cutouts 37 on opposite sides of the main bore, and two ramps 38 extending from one edge of each keyway cutout and extending in an arc partway around the main bore and ending prior to the beginning of the other keyway cutout. Optionally, the ramp may be parallel with the top surface of the horizontal bar or may be slanted from the top surface of the horizontal bar at the keyway opening down toward the bottom of the horizontal bar. Optionally, the ramps 38 may have a notch for engaging the keys of the base portion 55 of the flag indicator 50. In the embodiments shown in FIGS. 2A-C and 5A-D, the user attaches base portion 55 of flag indicator 50 to the horizontal bar 30 by inserting shaft 56 into main bore 36 with keys 57 passing through keyways 37, then twisting the knob 60 such that the keys 57 engage with ramps 38, thereby clamping the base portion to the horizontal bar.

Optionally, knob 60 may have a round, oval, or polygonal cross section and may have a smooth, textured, or knurled surface.

Openings 35 on the horizontal bar 30 enable adjustment of the flag indicator 50 location to accommodate players of different skill levels. The more proximally the flag indicator 50 is placed relative to the support block, and thus the shaft of the tee, the more difficult it is to avoid making contact between the bat and the flag indicator. The more distally the flag indicator 50 is placed, the easier it is to avoid contact with the bat. The more openings 35 in the horizontal bar 30, the more the hitting training device may be adjusted as a player improves. In one embodiment, the horizontal bar 30 comprises two openings 35. In another embodiment, the horizontal bar 30 comprises three openings 35. In another embodiment, the horizontal bar 30 comprises four openings 35. In another embodiment, the horizontal bar 30 comprises five openings 35. In another embodiment, the horizontal bar 30 comprises six openings 35. In another embodiment, the horizontal bar 30 comprises seven openings 35. In one embodiment, the opening 35 that is most proximal to support block 10 is located such that when the flag indicator 50 is placed in said opening, and when a baseball is placed on the tee, there is a distance between the ball and the flag indicator equal to the diameter of a baseball, or approximately 2.91 inches. In another embodiment, the opening 35 that is second most proximal to support block 10 is located such that when the flag indicator 50 is placed in said opening, and when a softball is placed on the tee, there is a distance between the ball and the flag indicator equal to the diameter of a softball, or approximately 3.82 inches.

In another embodiment, horizontal bar 30 contains a single, elongated opening 36 that extends nearly the entire length of the horizontal bar. This elongated opening is sized to accommodate an attachment mechanism on the base portion of the flag indicator 50, so as to allow the flag indicator to be located anywhere along the horizontal bar. The base portion of the flag indicator may be secured within the elongated opening 36 by friction fit, by clips, by spring-loaded lock, by twist-lock, or by threaded components above and below the surface of the horizontal bar 30.

The flag indicator 50 comprises a flag 51 and a base 55. The flag 51 is an elongated rod-like structure with a cross section that is round or oval wherein said cross section has a minimum diameter of between 0.25 and 2.0 inches and, wherein said flag portion is between 4.0 and 20.0 inches, in length. As shown in FIGS. 3A-D, flag 51 may be solid, hollow with closed ends, or hollow with one or both ends open. The flag 51 may be formed from any material that will withstand impact from a user's bat without cracking, breaking, or permanently bending, while also not damaging the bat. In one embodiment, the flag 51 is made from rubber. In another embodiment, the flag 51 is made from plastic. In another embodiment, the flag 51 may be made from multiple materials, for example a metal or wood core with a rubber or plastic exterior. So long as the flag 51 neither damages nor is damaged by the user's bat upon contact, any material or combination of materials is within the spirit of the invention and one of ordinary skill in the art would easily be able to identify such materials.

The base 55 releasably attaches to the horizontal bar 30. One method of attachment is described above with reference to FIGS. 2A-C and 5A-D, but many mechanisms are available for such attachment. By way of non-limiting examples, the base 55 may attach to the horizontal bar 30 by friction fit with or without one or more rubber gaskets, by threads, by clips, by spring-loaded lock, by push pin lock, or by twist-lock. These and other attachment methods are well-known and one of ordinary skill in the art would easily be able to identify means of attaching the base 55 to the horizontal bar 30 such that it remains secure when the flag 51 is contacted by a user's bat, but is able to be manually released from the horizontal bar by the user.

The flag 51 is releasably attached to the base 55. This may be accomplished by various methods, all of which are well-understood in the art. In one embodiment, the flag indicator 50 further comprises an elastic cord 66 connected to one end of the flag 51 and to a ball or other object 67. Elastic cord 66 passes through bore 58 in the base 55, but both the flag 51 on one side of the base and the ball 67 on the other side of the base are too large to fit through said bore. When the user's bat contacts the flag 51, it can deflect or detach from the base, stretching the elastic cord, which then pulls the flag back into the base. Optionally, the elastic cord may be attached at one end to the flag 51 and at the other end directly to the base 55. This breakaway feature prevents damage to the flag and/or base assembly as a result of contact with the user's bat.

Figure 4A:
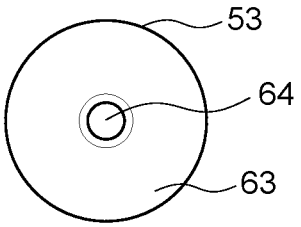
FIG. 4A shows a bottom view of the flag plug in one embodiment of the hitting training device.
Figure 4B:
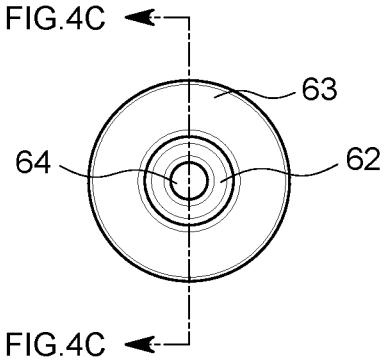
FIG. 4B shows the top view of the flag plug in one embodiment of the hitting training device.
Figure 4C:
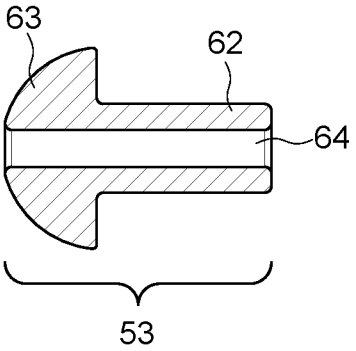
FIG. 4C shows a cross sectional view of the embodiment shown in FIG. 4B.
Figure 5A:
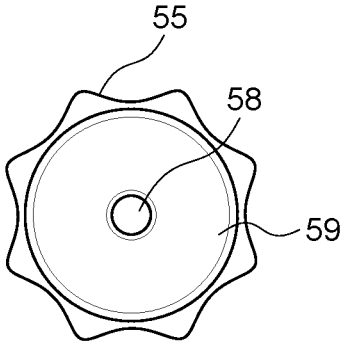
FIG. 5A shows a top view of the flag base in one embodiment of the hitting training device.
Figure 5B:
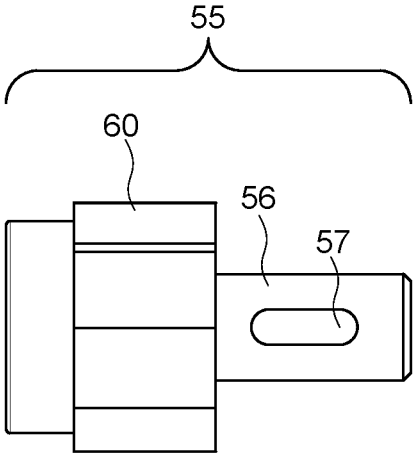
FIG. 5B shows a lateral view of the flag base in one embodiment of the hitting training device.
Figure 5C:
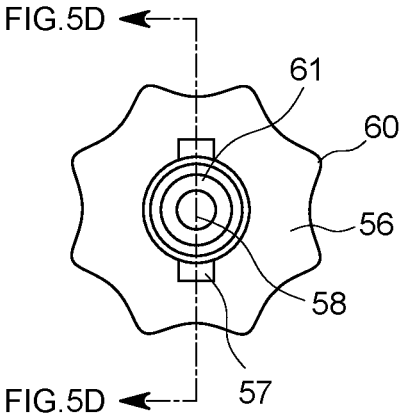
FIG. 5C shows a bottom view of the flag base in one embodiment of the hitting training device.
Figure 5D:
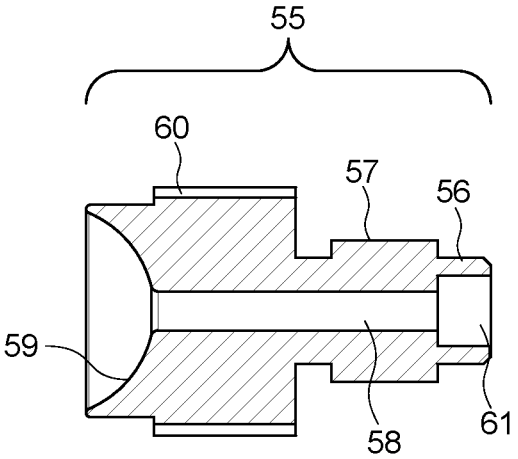
FIG. 5D shows a cross sectional view of the embodiment shown in FIG. 5C.
Figure 8:
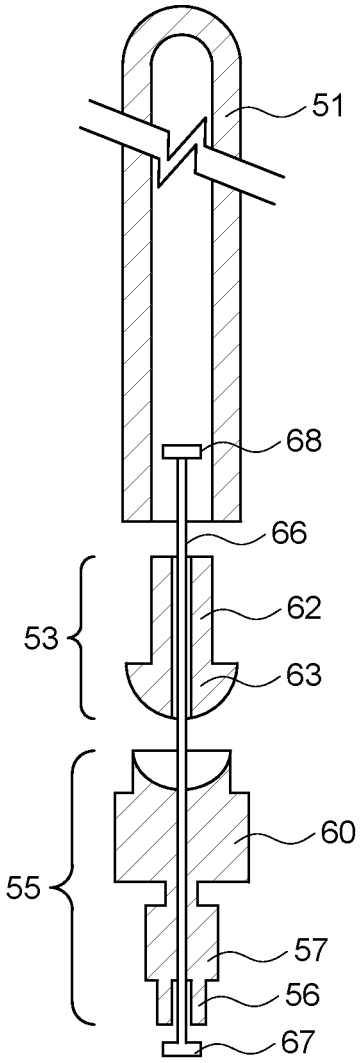
FIG. 8 shows a cross-sectional, exploded view of one embodiment of the flag indicator, including the flag portion, plug, base portion, and elastic cord.

In one embodiment, the flag indicator 50 further comprises a plug 53 that inserts into the bottom end of the flag 51. FIGS. 4A-C show one embodiment of such plug 53. Plug 53 comprises a shaft 62 sized to snugly insert into a bore or recess in the bottom end of flag 51, an enlarged head 63 with a flat upper surface and rounded bottom surface, and a bore 64 passing through the center of the plug from top to bottom. In this embodiment, as shown in FIG. 8, flag indicator 50 is assembled as follows. One end of elastic cord 66 passes through bore 64 from the bottom of plug 53 to the top and is secured in place either by tying a knot that will not fit through bore 64, or by connecting to an object 68 that will not fit through bore 64. Plug 53 is then inserted into the bottom end of flag 51. The other end of elastic cord 66 is then passed through bore 58 of base 55 and is secured in place by either tying a knot that will not fit through bore 58 or by connecting to an object 67 that will not fit through bore 58. The rounded bottom surface of the enlarged head 63 of the plug 53 is sized to correspond to the convex recess 59 of the top surface of the base 55.

In another embodiment, the flag 51 is attached to a non-elastic cord passing through bore 58 in the base 55, which in turn is connected to a counterweight. When the flag is contacted by the user's bat, it deflects or detaches from the base, lifting the counterweight. The counterweight then drops back down, lifting the flag back onto the base. In another embodiment, the flag 51 is attached to base 55 using one or more springs, which enable the flag to bend away from the base when contacted with the user's bat and then return to its original position on the base. In another embodiment, the flag 51 connects to the base 55 using magnets. Optionally, a string or elastic cord may be connected at one end to the flag and the other end to the base, such that when the flag is struck by the user's bat and disconnected from the base, it does not fly far away from the tee or land on the ground. The user then lifts the flag back onto the base, reengaging the magnets.

Figure 6A:
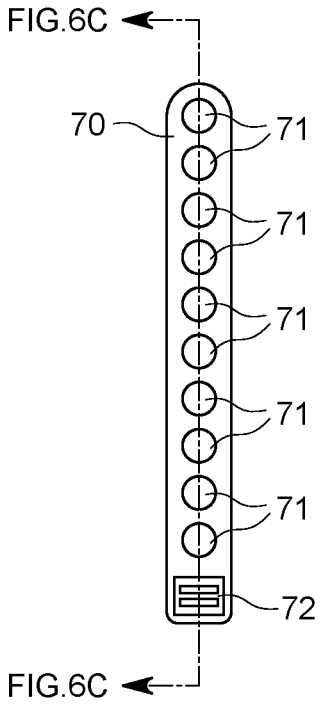
FIG. 6A shows a front view of one embodiment of the attachment strap of the hitting training device.
Figure 6B:
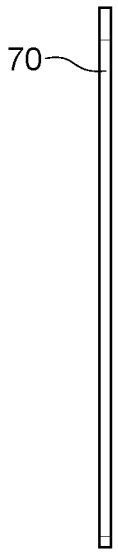
FIG. 6B shows a top view of one embodiment of the attachment strap of the hitting training device.
Figure 6C:
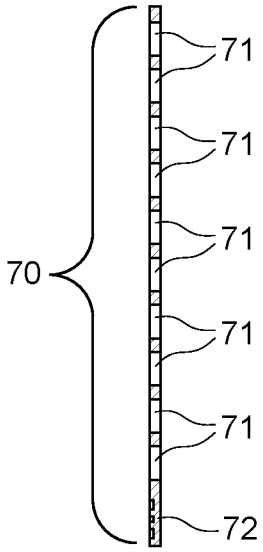
FIG. 6C shows a cross sectional view of the embodiment shown in FIG. 6A.
Figure 6D:
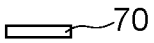
FIG. 6D shows a side view of one embodiment of the attachment strap of the hitting training device.
Figure 7:
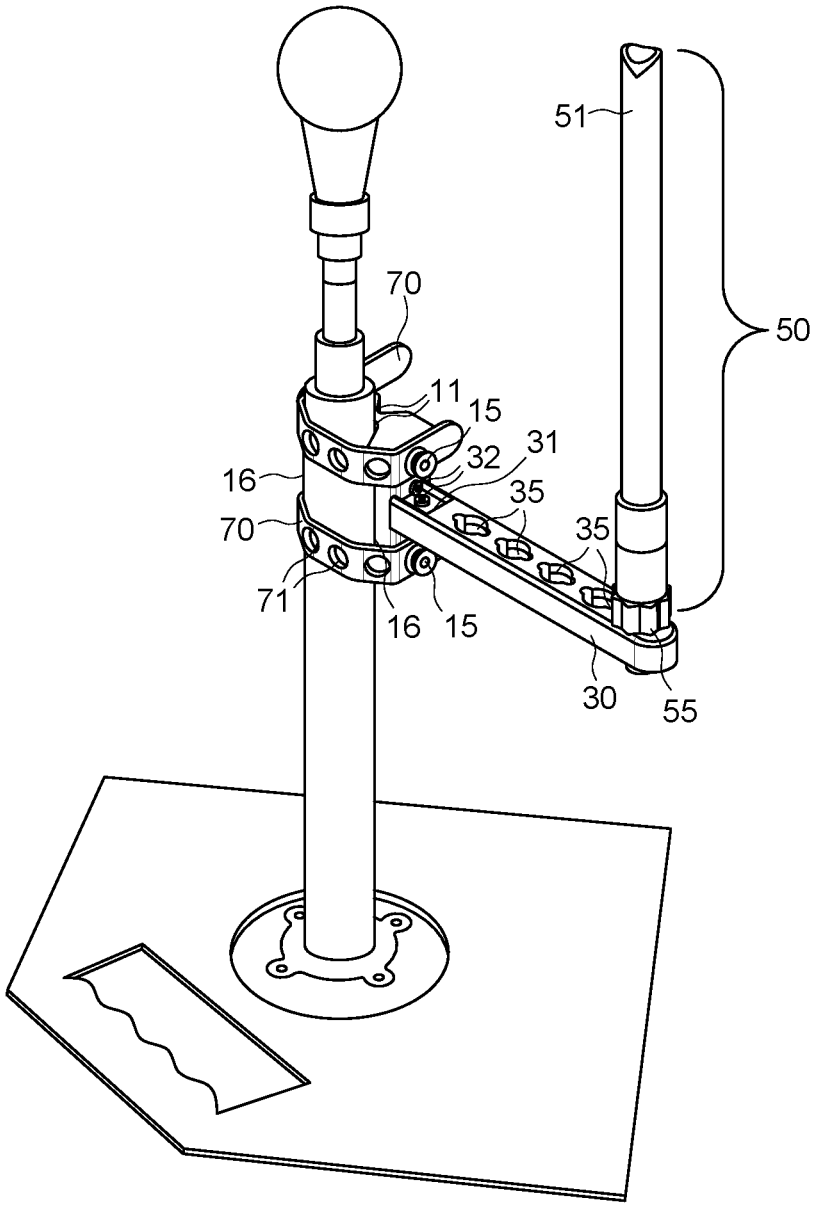
FIG. 7 shows a perspective view taken from the front, top, and right side of a representative embodiment of the assembled hitting training device as it is attached to the shaft of a baseball or softball tee.

Attachment straps 70 are used to secure the support block 10 to the shaft of a baseball/softball tee. Various types of attachment straps are contemplated in the invention. In one embodiment, attachment straps 70 are made of rubber or other elastic material. The attachment straps are permanently attached to one side of the support block 10 and contain a plurality of holes 71. The user places one of the grooves in support block 10 against the shaft of the tee, then pulls the attachment strap(s) tightly across the shaft of the tee and places one of the holes 71 over knob 15 on the opposite side of support block 10. Alternatively, attachment strap(s) 70 may not be permanently attached to support block 10. As shown in FIG. 7, one of the holes of support strap 70 is placed over a knob 15 on one side of support block 10 or is secured to the side of support block 10 by means of a screw or bolt, and then the attachment strap is pulled tightly across the shaft of the tee and another hole 71 is placed over a knob 15 on the opposite side of support block 10. Optionally, as shown in FIG. 6A, raised ridges 72 may be located at one end of attachment strap 70 to facilitate easier grip of the attachment strap as it is being stretched across the shaft of the tee and secured to knob 15 on the other side of support block 10.

In another embodiment, attachment strap(s) 70 comprise a ratcheting buckle system, such as the closure taught in U.S. Pat. No. 3,662,435 issued to Allsop. In another embodiment, the attachment strap(s) 70 and support block 10 comprise a recessed key and traction cable system, such as the closure system taught in U.S. Pat. No. 4,823,484 issued to Couty. The embodiments described above are exemplary only. Many other attachment systems are known and one of ordinary skill in the art would understand what system would sufficiently secure support block 10 to the shaft of a baseball/softball tee. All such means are within the scope of the present invention.

With respect to the above description, the optimum dimensional relationships for the parts of the invention, to include variations in size, materials, shape, form, function and manner of operation, assembly and use, are readily apparent and obvious to one of ordinary skill in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A baseball and softball hitting training device comprising:

a support block with a groove on one vertical face extending from the top surface of the support block to the bottom surface of the support block;

a horizontal bar extending perpendicular to the support block, comprising one or more openings on the top surface;

a flag indicator connected perpendicular to the horizontal bar, comprising a flag portion and a base portion;

one or more attachment straps that releasably connect to the support block, and an elastic cord connecting said flag portion and said base portion.

2. The baseball and softball hitting training device according to claim 1, further comprising a plug inserted into the bottom end of the flag portion.

* * * * *